US010245572B2

(12) United States Patent
Bailey, III

(10) Patent No.: US 10,245,572 B2
(45) Date of Patent: Apr. 2, 2019

(54) FLUID MIXING SYSTEM

(71) Applicant: Potable Water Solutions, LLC, Washington, NC (US)

(72) Inventor: Harry Bailey, III, Washington, NC (US)

(73) Assignee: Potable Water Solutions, LLC, Washington, NC (US)

( * ) Notice: Subject to any disclaimer, the term of this patent is extended or adjusted under 35 U.S.C. 154(b) by 570 days.

(21) Appl. No.: 15/001,567

(22) Filed: Jan. 20, 2016

(65) Prior Publication Data

US 2016/0214073 A1 Jul. 28, 2016

Related U.S. Application Data

(60) Provisional application No. 62/107,013, filed on Jan. 23, 2015.

(51) Int. Cl.

| | |
|---|---|
| ***B01F 15/00*** | (2006.01) |
| ***B01F 15/02*** | (2006.01) |
| ***B01F 5/10*** | (2006.01) |
| ***B01F 5/02*** | (2006.01) |
| ***B01F 13/04*** | (2006.01) |

(52) U.S. Cl.

CPC ..... *B01F 15/0035* (2013.01); *B01F 5/0206* (2013.01); *B01F 5/10* (2013.01); *B01F 5/108* (2013.01); *B01F 13/047* (2013.01); *B01F 15/00155* (2013.01); *B01F 15/0243* (2013.01)

(58) Field of Classification Search

CPC .. B01F 5/102; B01F 5/108; B01F 5/10; B01F 15/0243; B01F 5/0206; B01F 15/0035; B01F 13/047; B01F 15/00155

See application file for complete search history.

(56) References Cited

U.S. PATENT DOCUMENTS 4,747,757 A * 5/1988 Haentjens ..... F04D 13/086 366/263

2005/0263450 A1* 12/2005 McGrew, Jr. ..... B01D 35/26 210/416.1

OTHER PUBLICATIONS

EP2730345 to Kjellberg which application was published May 14, 2014. (Year: 2014).*

* cited by examiner

*Primary Examiner* — Anshu Bhatia

(74) *Attorney, Agent, or Firm* — Ward and Smith, P.A.; Ryan K. Simmons

(57) ABSTRACT

A fluid mixing system including, an upper assembly, comprising a submersible pump housed therein; a base assembly connected to the upper assembly, the base assembly comprising one or more diffusers connected to opposing end portions of the base assembly; and a fluid path fluidly connecting the upper assembly and base assembly, wherein the fluid path extends from an outlet of the submersible pump to the one or more diffusers, and wherein the one or more diffusers are configured to provide a fluid outlet from the fluid path to create movement of fluid within a fluid reservoir.

18 Claims, 3 Drawing Sheets

FLUID MIXING SYSTEM

RELATED APPLICATIONS

This application is related to and claims priority to U.S. Provisional Patent Application No. 62/107,013, filed on Jan. 23, 2015, entitled "Potable Water Mixing System"; the entire disclosure of which is incorporated herein by reference.

FIELD OF THE INVENTION

This invention pertains generally to a fluid mixing system, more particularly, a potable water mixing system for use in ground and/or elevated water distribution reservoir tanks.

BACKGROUND OF THE INVENTION

Most drinking (potable) water distribution reservoirs are designed to fill and draw out from the bottom. This means that without mixing, the last water entering the reservoir is usually the first water to flow out. The stratification that occurs due to this design creates several water quality issues with regard to disinfectant levels and disinfection byproducts. Weather related temperature changes or a dramatic difference between the source water temperature and the ambient temperature of the tank may also cause stratification. Colder water is denser and negatively buoyant and therefore stays in the lowest portion of the tank. To help improve water quality and to meet regulatory requirements, mixing systems are typically used. Current mixing systems utilize draft tubes, air bubbling, duckbill, or mechanical (screw) type mixers.

A difference in temperature of inlet water and tank water can allow stratification to occur. Stratification can occur year round, but is most problematic during warm season months. The colder inlet water is denser, negatively buoyant and therefore stays in the lowest portion of the tank. Without a mixing system, each additional fill and draw cycle will continually increase the water age in the top part of the tank. This allows water quality problems to develop such as a loss of disinfectant residual, increase in total trihalomethanes (TTHM), and bacteria regrowth.

There is a need for an improved potable water mixing system for achieving complete mixing to yield a homogenous solution throughout the tank water volume and eliminating any thermal, chemical, and microbiological stratification, thereby preserving water quality.

There is also a need for a potable water mixing system that can be used in a number of below ground and/or elevated water storage tanks of varying sizes and dimensions.

BRIEF DESCRIPTION OF THE INVENTION

In one embodiment the invention provides a fluid mixing system. The fluid mixing system may include an upper assembly, comprising a submersible pump housed therein; a base assembly connected to the upper assembly, the base assembly comprising one or more diffusers connected to opposing end portions of the base assembly; and a fluid path fluidly connecting the upper assembly and base assembly, wherein the fluid path extends from an outlet of the submersible pump to the one or more diffusers, and wherein the one or more diffusers are configured to provide a fluid outlet from the fluid path to create movement of fluid within a fluid reservoir. The fluid mixing system may further include a well screen disposed atop the upper assembly and in fluid connection with the submersible pump. The upper assembly may be connected to approximately a mid-point of the base assembly to form an inverted T configuration, wheren the upper assembly extends in a vertical direction and the base assembly extends in a horizontal direction. The opposing end portions of the base assembly each may include a T pipe assembly. The one or more of the one or more diffusers may be connected to one or more ends of the T pipe assembly. The fluid path may include a first pipe section, a second pipe section, and a third pipe section, wherein the first pipe section is connected at its first end to the outlet of the submersible pump and at its second end to the second and third pipe section to form an inverted T configuration, wherenin the first pipe section extends in a verticle direction and the second and third pipe section, positioned end to end, extend in a horizontal direction in a opposing directions from one another. The first pipe section, second pipe section, and third pipe section may be connected via a T connector. The second pipe section and the third pipe section may each include a first portion and a second portion, wherein a diameter of the first portion is greater than that of the second portion. Each T pipe assembly may include a T pipe section connected at about its mid-point, one to each of the second pipe section and to the third pipe section in a T configuration at each of the opposing end portions of the base assembly. The fluid mixing system may further include a pipe reducer disposed between the outlet of the submersible pump and the first pipe section. Each T pipe section may include a first end portion and a second end portion. One or more of the diffusers may be connected to the first end portion and/or the second end portion of each T pipe section. The diameter of the one or more diffusers may be less than the diameter of the first end portion and the second end portion of the T pipe section. The one or more diffusers may be postioned at a certain angle relative to the T pipe section and/or a horizontal surface of a bottom of a reservoir within which the fluid mixing system is installed, wherein the certain angle is calculated based on one or more of reservoir tank geometry, reservoir tank size, size of the submersible pump, and desired fluid volume turnover. The length of the well screen may be determined by a high and low set points defined for a reservoir within which the fluid mixing system is installed. The fluid mixing system may further include an inverted pipe reducer disposed between the well screen and the upper assembly. The fluid mixing system may further include a low fluid cutoff sensor configured to turn the submersible pump off when a fluid level of a reservoir within which the fluid mixing system is installed reaches a pre-determined low fluid set point. The upper assembly may further include a stability plate for stabilizing the submersible pump. The fluid mixing system may further include one or more of mounting clips and a brace configured for securing the fluid mixing system within a reseveroir in which the the fluid mixing system is installed. The fluid mixing system may further include one or more torque arrestors positioned within the base assembly, wherein the one or more torque arrestor are positioned relative to the second pipe portion and/or the third pipe portion.

These and other embodiments will be apparent from the ensuing specification.

BRIEF DESCRIPTION OF THE DRAWINGS

Figure 1A:
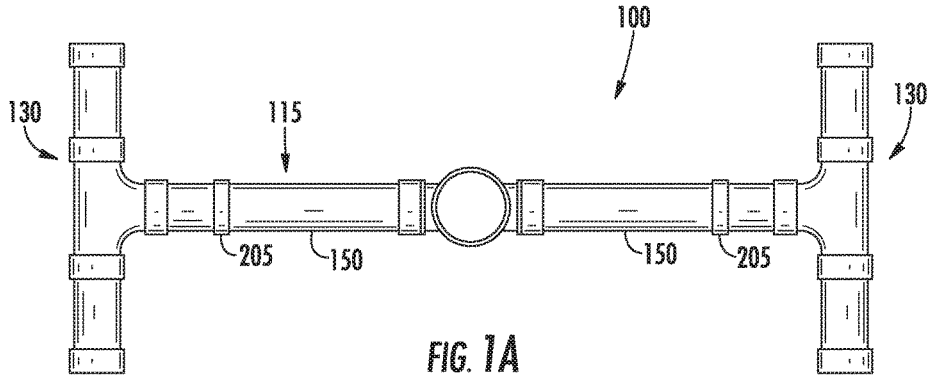
Figure 1B:
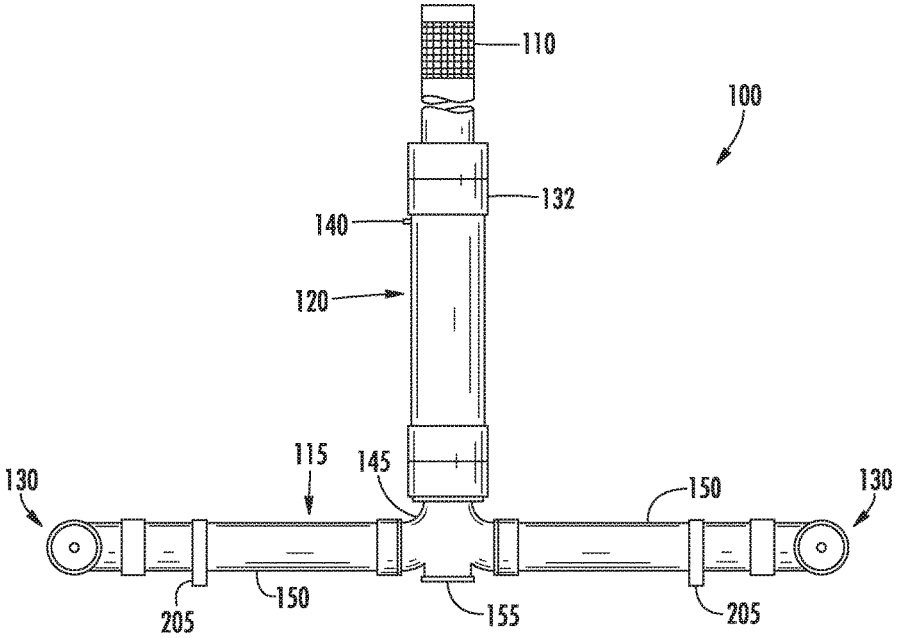

Having thus described the presently disclosed subject matter in general terms, reference will now be made to the accompanying Drawings, which are not necessarily drawn to scale, and wherein:

FIGS. 1A and 1B illustrate a top plan view and a side view respectively of a potable water mixing system in accordance with an embodiment of the invention.

Figure 2A:
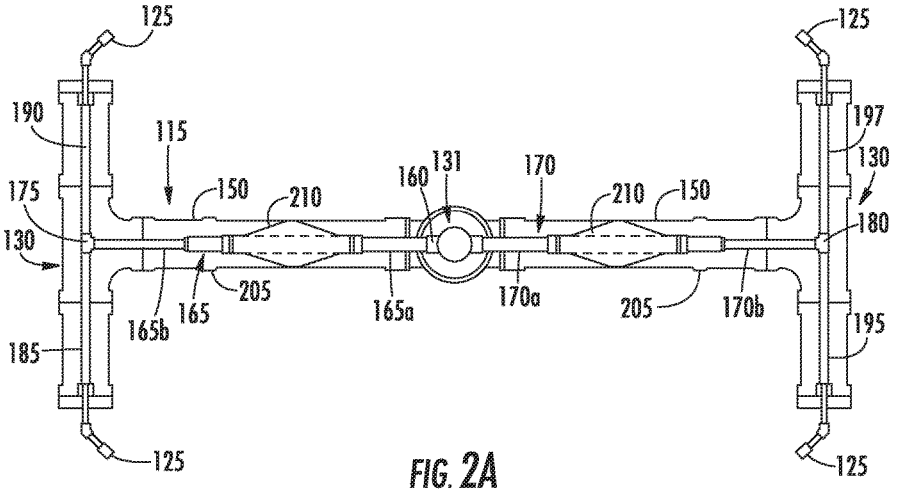
Figure 2B:
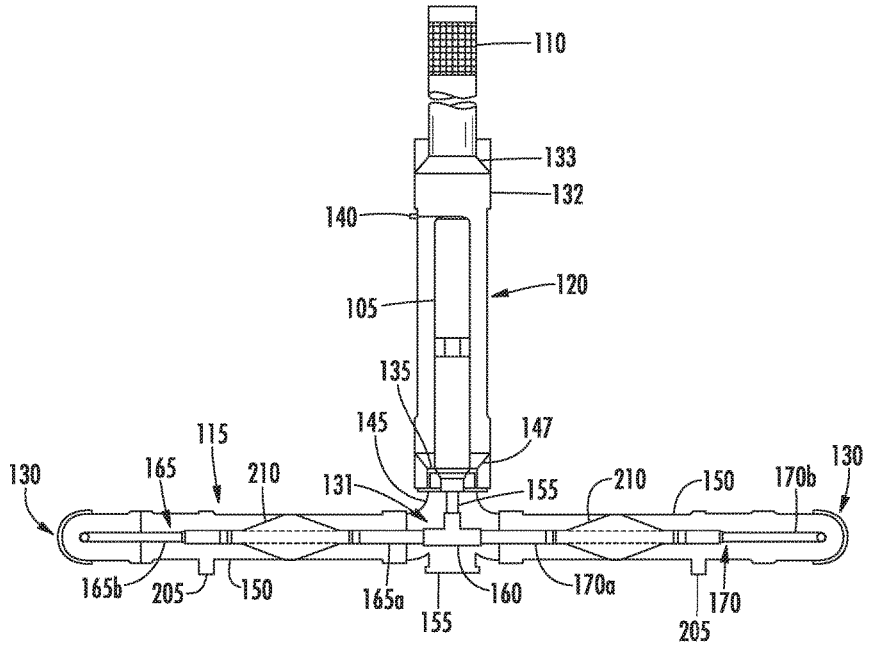

FIGS. 2A and 2B illustrate cross sectional top plan view and a cross sectional side view respectively of the potable water mixing system in accordance with an embodiment of the invention.

Figure 3:
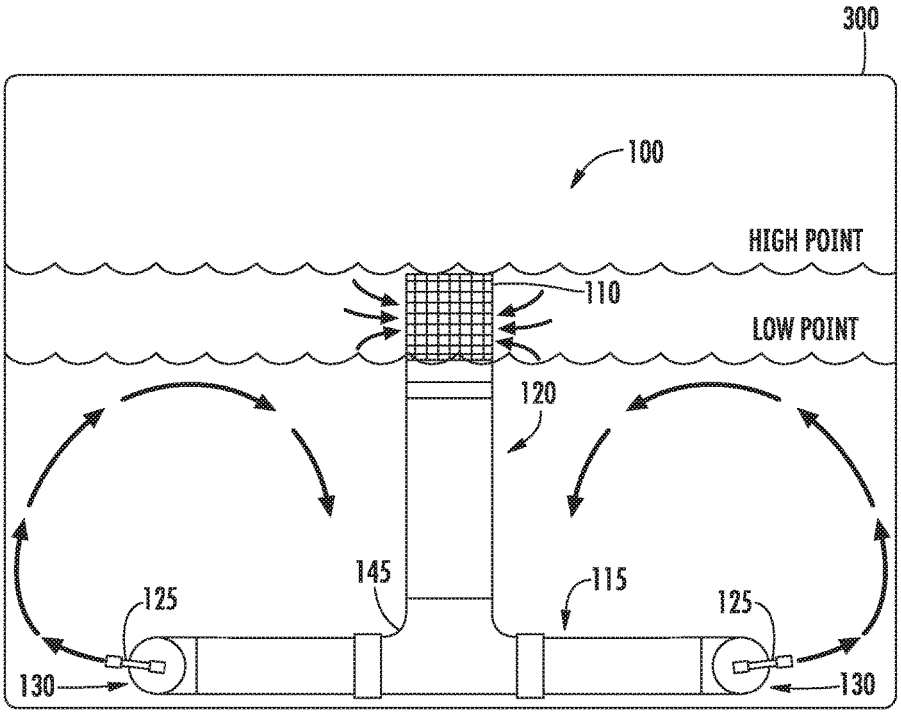

FIG. 3 illustrates a potable water storage tank with a potable water mixing system therein.

DETAILED DESCRIPTION OF THE INVENTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof.

The potable water mixing system of the invention utilizes a submersible pump to facilitate cycling of water located in an upper portion of a reservoir to a lowest portion of the reservoir. In a conventional well design, the submersible pump moves water from the bottom of the well upward to the ground surface. In such a traditional well design, a slotted screen is set near a bottom of the well that allows groundwater to enter a casing pipe and then a submersible pump moves the water upward to the surface. In the potable water mixing system of the invention, a well screen is positioned at the normal operating levels of a water tank (i.e., in an upper portion of the reservoir). This design allows the potable water mixing system to use the entire reservoir as it was originally designed with regard to storage capacity and to facilitate cycling of water from the upper portion of the reservoir to the lower portion of the reservoir.

Part of the regulated disinfection byproducts is trihalomethanes (TTHM), which are volatile organic compounds. Trihalomethanes occur when naturally-occurring organic and inorganic materials in the water rect with the disinfectants, chlorine, or chloramines. Some people who drink water containing trihalomethanes, in excess of the maximum contaminant level (MCL) set by the United States Environmental Protection Agency (EPA) for drinking water quality, over many years may potentially experience, or be at risk for, liver, kidney, or central nervous system problems and increased risk of cancer. In the present potable water mixing system, TTHM is released from the water near the surface and into the air based on Henry's Law, and the potable water mixing system moves water located near the top of the reservoir to the lowest portion of the reservoir. This exchange of water (moving water located near the top of the reservoir to the lower portion of the reservoir), creates circulation and therefore allows upward movement. This upward movement allows further release of TTHM out of the water and into the air as the water nears the surface, thus reducing the amount of TTHM in the actual water supply. Further, the present potable water mixing system does not utilize aeration or air bubbling like some existing mixing systems, which may create a loss of disinfectant residuals, thus reducing the disinfectant's effectivness.

Therefore, the present mixing system does not cause the degradation of disinfectant residuals and provides improved water movement and facilitate de-stratification while allowing stabile disinfectant levels to be maintained throughout the reservoir.

With reference to FIGS. 1A, 1B, 2A, and 2B a potable water mixing system 100 is provided. Potable water mixing system 100 preferably includes a submersible pump 105, a well screen 110, a base piping assembly 115, an upper piping assembly 120, and diffusers 125. Well screen 110 is preferably positioned atop upper piping assembly 120. Submersible pump 105 is preferably housed in an inner portion of upper piping assembly 120 and in fluid connection with well screen 110. Upper piping assembly 120 and base piping assembly 115 are preferably connected to one another in an inverted T formation, such as shown in FIGS. 1B and 2B. Base piping assembly 115 further includes base pipes 150 and T pipe sections 130, wherein the T pipe sections 130 are positioned at distal ends of base pipes 150 and are thus positioned at opposing ends of base piping assembly 115. Base pipes 150 are connected at their proximal ends to upper piping assembly 120 via a T connector 145, thus connecting upper piping assembly 120 with base piping assembly 115.

Diffusers 125 are preferably affixed to ends of T pipe sections 130. In one embodiment, diffusers 125 are positioned at opposing ends of the "T" portion of each T pipe section 130. Potable water mixing system 100 further includes a fluid path 131 extending from submersible pump 105 through the remaining portion of upper piping assembly 120, base piping assembly 115, T pipe sections 130, and terminating at diffusers 125, thus providing a fluid connection from submersible pump 105 to diffusers 125.

Well Screen 110 may be secured to upper piping assembly 120 using any conventional mechanism suitable for doing so. In one example, well screen 110 may be secured to upper piping assembly 120 using a conventional PVC coupler 132, and may include an inverted pipe reducer 133, e.g., a 4" to 6" diameter inverted pipe reducer. In one embodiment, a 4" to 6" diameter inverted pipe reducer 133 allows for well screen 110 to be attached to an upper piping assembly 120 having a 6" diameter pipe. The 6" diameter pipe provides adequate room for submersible pump 105 to be housed within upper piping assembly 120 and to also create sufficient room around the intake of submersible pump 105 for its proper operation. Upper piping assembly 120 may be in the range of about a 6" diameter PVC pipe and its height is of sufficient length to accommodate an appropriately sized submersible pump 105 therein, the size of which is largly determined by the particular size of the reserver in which the potable water mixing system 100 is installed. For example, in a circular ground tank reservoir with about a 50' inside diameter and about a 250,000 gallon (0.25 MG) capacity, upper piping assembly 120 may be in a range of about 16' to about 18' in height.

Upper piping assembly 120 may further include a stability plate 135 for submersible pump 105 to sit on thereby providing pump stability. Submersible pump 105 may be additionally secured in place using one or more securing mechanism, such as bolt 140, which further secures submersible pump 105 to upper piping assembly 120. T connector 145 for connecting upper piping assembly 120 to base piping assembly 115 may be a conventional PVC T connector/cross type connector. Upper piping assembly 120 may be connected to the PVC T connector/cross type connector 145 using a conventional PVC coupler, and may include a pipe reducer 147, e.g., 6" to 4" diameter.

The dimensions (length and/or diameter) of the various components of the potable water mixing system 100 (e.g., well screen 110, base piping assembly, upper pipping assembly 120, T pipe sections 130, base pipes 150, etc.), depend on the size of the reserver in which the potable water mixing system 100 is installed and may be customized to fit/operater in a number of different sized reservoirs. Further, the size/capacity of submersible pump 105 depends on the size of the reserver in which the potable water mixing system 100 is installed; a larger capacity reservoir may require a larger capacity pump than that of a lower capacity reservoir. Submersible pump 105 may be any number of submersible pumps. For example, submersible pump 105 may be a 4" submersible pump that range from about ½ HP-5 gpm (gallons per minute) to about 7½HP-80 gpm. However, other pump sizes and capacities, smaller or greater than noted here, may be used based on the size of reservoir the system is to be installed in. Well screen 110, may, for example, be a plastic (or other suitable material) slotted well screen, and may have slot sizes ranging from about 0.008 inch to about 0.120 inch. The choice of well screen slot size, in addition to the length of well screen 110 determines the volume of fluid flow to submersible pump 105.

The components of potable water mixing system 100 can be easily customized to allow for installation and operation in a number of different size/capacity reservoirs.

Base pipes 150 may each be connected at their proximal ends to their respective portion of T connector 145 that connects the base piping assembly 115 to the upper piping assembly 120. In an embodiment using cross type connector for T connector 145 a cap 155 may be used to seal an opening (if present) of the cross type connector 145 that is not connected to base pipes 150 or upper piping assembly 120. The dimentions (length/diameter) of base pipes 150, as mentioned above, depend on the size of the reserver in which the potable water mixing system 100 is installed and may be customized to fit/operater in a number of different sized reservoirs. For example, in a circular ground tank reservoir with about a 50' inside diameter and about a 250,000 gallon (0.25 MG) capacity, base pipes 150 may be in a range of about 15' to about 23' in height. Each of base pipes 150 is further connected to T pipe sections 130 wich are positioned at a distal portion thereof. T pipe section 130 may include diffusers 125 positioned at opposite ends of each of the "T" portions of T pipe sections 130 and are in fluid connection with fluid path 131.

Fluid path 131 preferably provides a path for water to flow from an outlet of submersible pump 105 and ultimately to diffusers 125. In one embodiment, fluid path 131 includes a first pipe section 155, a second pipe section 165, and a third pipe section 170. First pipe section 155 is preferably connected in a vertical orientation at one end to an outlet of submersible pump 105 and at its second end to second pipe section 165 and third pipe section 170. In one example, first pipe section 155 may be connected to second pipe section 165 and third pipe section 170 via a T connector 160. Second pipe section 165 and third pipe section 170 each preferably connect to corresponding open portions of T connector 160 at their proximal ends and extend in a substantial horizontal direction from T connector 160. Second pipe section 165 and a third pipe section 170, may each include a first portion 165*a*, 170*a* and a second portion 165*b*, 170*b* respectively, wherein the first portions 165*a*, 170*a* have a greater diameter than the second portions 165*b*, 170*b* (e.g., first portion may be 1" diameter pipe and second portion may be ¾" diameter pipe). Such a design facilitates an increase in water velocity in fluid path 131 as it travels toward, and ultimately out of, diffusers 125. Second pipe section 165 and third pipe section 170 each preferably connect to a respective second T connector 175 and 180 respectively at their distal ends. Fluid path 131 may further include a fourth pipe section 185, a fifth pipe section 190, a sixth pipe section 195, and a seventh pipe section 197. Fourth pipe section 185 and fifth pipe section 190 are each preferably connected to corresponding open portions of T connector 175 at their proximal ends and extend in a substantial horizontal direction from T connector 175 and are substantially perpendicular to second pipe section 165. Sixth pipe section 195 and seventh pipe section 197 are each preferably connected to corresponding open portions of T connector 180 at their proximal ends and extend in a substantial horizontal direction from T connector 180 and are substantially perpendicular to second pipe section 170.

Fourth pipe section 185, fifth pipe section 190, sixth pipe section 195, and seventh pipe section 197 preferably include at least one of diffusers 125 connected to an end portion thereof. Diffusers 125 are configured to provide a water outlet from fluid path 131, thus facilitating movement of water in the reservoir. Diffusers 125 may be a reduced diameter pipe as compared to that of the respective pipe section it is connected to, and for example, may be connected to the end portion of their respective pipe sections using a reducer, e.g., ¾" to ½". Diffusers 125 are preferably positioned at an angle relative to their respective pipe section (i.e., fourth pipe section 185, fifth pipe section 190, sixth pipe section 195, and seventh pipe section 197) and/or the bottom of the reservoir. The angle of diffusers 125 may be calculated based on, amongst other thing, specific tank geometry/size, pump size, and desired volume turnover. In one embodiment, the angle of diffusers 125 is computer modeled prior to use in a particular reservoir to determine the correct angle settings. It will be appreciated that other aspects of the potable water mixing system 100 may also be computer modeled based on the specific application (tank size, geometry, etc.) to determine the required/optimal specifications for the design of the potable water mixing system 100 (e.g., pump size, diffuser angle, well screen length, pipe dimensions, etc.).

Potable water mixing system 100 is preferably constructed from the same or similar material that is acceptable for use in the potable drinking water field and is NSF approved. In one example the piping material is PVC, such as that normally used for water line construction or for well casings. Submersible pump 105 may be a conventional submersible pump, such as that typical used in a well application. The size of submersible pump 105, the length of well screen 110, and dimensions of upper piping assembly 120 and base piping assembly 115 are reservoir tank specific, and as previously noted may be computer modeled prior to installation to optimize the potable water mixing system 100 for the specific reservoir tank. For example, the capacity of submersible pump 105 is dependent on the size of the reservoir and the amount of tank turnover required for meeting the desired water quality. Further, the length of well screen 110 is determined by the high and low set points for the water reservoir. By basing the length of well screen 110 on the reservoir's the high and low set points, it will allow the water system to use the entire reservoir as it was originally designed with regard to storage capacity. A water reservoir tank is normally equipped with a high and low water setting, which means that water will enter the reservoir tank until it reaches a specific high water level and then will empty until it reaches a specific low water level. In one embodiment, to protect submersible pump 105 from running dry, a low water cutoff sensor (not shown) may be installed as an additional safety measure. The low water cutoff sensor may be installed between the well screen and the submersible pump.

Ground storage reservoirs are generally constructed from concrete and have a flat bottom. In a potable water mixing system 100 for use in a ground storage tank, potable water mixing system 100 may sit on the bottom and be attached to the reservoir. For example, potable water mixing system 100 may be attached to the bottom of the ground storage tank using mounting clamps 205. Mounting clamps 205, are not a structural component, but are designed to keep the system secured in place and therefore from moving from the designed installation location. Elevated storage tanks are generally designed with a riser pipe at the center of the reservoir bowl. A brace, such as a piece of stainless steel scaffolding (not shown) may be installed to bridge with the riser pipe, thus, allowing the potable water mixer system 100 to be attached to the brace to secure it in place and prevent movement.

The potable water mixer system 100 may further include additional components. For example, one or more sampling ports (not shown) may be installed at different location along the system to monitor water quality. The sampling ports may be utilized to measure disinfectant levels, temperature, disinfectant byproducts, etc. Ideal locations for the sampling ports would preferably be near the base of the reservoir, middle of the normal operating water level, and near the base of well screen 110 intake. These locations would assist in evaluating the water quality in the reservoir tank and to determine if adjustments are needed in the operation of the potable water mixer system 100. Additionally, potable water mixer system 100 may include torque arrestors 210 positioned within the base piping section 115. In one embodiment, a torque arrestor 210 is positioned relative to each of second pipe section 165 and third pipe section 170, for example at first portions 165*a* and 170*a* of second pipe section 165 and third pipe section 170 respectively. Torque arrestor 210 may assist in reducing unwanted vibration and movement in potable water mixer system 100 during use.

FIG. 3 shows potable water mixer system 100 in a reservoir tank 300 (not drawn to scale) and illustrates an example water circulation pattern. Reservoir tank may be a ground or elevated water distribution reservoir. In such a system water is drawn into fluid path 131 by submersible pump 105, where the water is then pumped through fluid path 131 and out of diffusers 125. Whereby, circulation of the water is promoted within the reservoir.

The foregoing detailed description of embodiments refers to the accompanying drawings, which illustrate specific embodiments of the invention. Other embodiments having different structures and operations do not depart from the scope of the present invention. The term "the invention" or the like is used with reference to specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation.

Following long-standing patent law convention, the terms "a," "an," and "the" refer to "one or more" when used in this application. Thus, for example, reference to "a subject" includes a plurality of subjects, unless the context clearly is to the contrary (e.g., a plurality of subjects), and so forth.

Throughout this specification, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions. Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

What is claimed is:

1. A fluid mixing system, comprising:

a. an upper portion, comprising an upper piping assembly and a submersible pump housed within the upper piping assembly;

b. a base portion connected to the upper portion, the base portion comprising a bottom piping assembly and one or more diffusers connected to opposing horizontal extending end portions of the bottom piping assembly, wherein the upper portion and the base portion form an inverted T configuration the upper portion being substantially vertical and the base portion being substantially horizontal; and wherein the upper portion and the base portion are configured for being installed within a fluid reservoir; and c. a fluid path fluidly connecting the upper piping assembly and bottom piping assembly, wherein the fluid path extends from an outlet of the submersible pump to the one or more diffusers, and wherein the one or more diffusers are configured to provide a fluid outlet from the fluid path to create movement of fluid within a fluid reservoir, and wherein the one or more diffusers are positioned at a certain fixed angle relative to the bottom piping assembly and/or a horizontal surface of a bottom of the fluid reservoir which the fluid mixing system is installed wherein each of the opposing end portions of the bottom piping assembly each comprises a T pipe assembly.

2. The fluid mixing system of claim 1 wherein the upper portion further comprising a well screen disposed atop the upper piping assembly and in fluid connection with the submersible pump.

3. The fluid mixing system of claim 1 wherein the upper portion is connected to approximately a mid-point of the base portion.

4. The fluid mixing system of claim 1 wherein the one or more diffusers are connected to one or more ends of the T pipe assembly.

5. The fluid mixings system of claim 1 wherein the fluid path comprises a first pipe section, a second pipe section, and a third pipe section, wherein the first pipe section is connected at its first end to the outlet of the submersible pump and at its second end to a T connector connecting the first pipe section with the second and third pipe sections wherein the first pipe section extends in a vertical direction within the upper piping assembly and the second and third pipe sections, positioned end to end, extend in a horizontal direction in opposing directions from one another within the bottom piping assembly, the first, second, and third pipe sections forming an inverted T configuration.

6. The fluid mixing system of claim 5 wherein the second pipe section and the third pipe section each comprise a first portion and a second portion, wherein a diameter of the first portion is greater than that of the second portion.

7. The fluid mixing system of claim 5 wherein each T pipe assembly comprises a T pipe section connected at about its mid-point, one to each of the second pipe section and to the third pipe section in a T configuration at each of the opposing end portions of the bottom piping assembly.

8. The fluid mixing system of claim 5 further comprising a pipe reducer disposed between the outlet of the submersible pump and the first pipe section.

9. The fluid mixing system of claim 7 wherein each T pipe section comprises a first end portion and a second end portion.

10. The fluid mixing system of claim 9 wherein one or more of the diffusers are connected to the first end portion and/or the second end portion of each T pipe section.

11. The fluid mixing system of claim 10 wherein a diameter of the one or more diffusers is less than the diameter of the first end portion and the second end portion of the T pipe section.

12. The fluid mixing system of claim 1 wherein the certain fixed angle is calculated based on one or more of reservoir tank geometry, reservoir tank size, size of the submersible pump, and desired fluid volume turnover.

13. The fluid mixing system of claim 2 wherein the length of the well screen is determined by a high and low set points defined for a reservoir within which the fluid mixing system is installed.

14. The fluid mixing system of claim 2 further comprising an inverted pipe reducer disposed between the well screen and the upper piping assembly.

15. The fluid mixing system of claim 1 further comprising a low fluid cutoff sensor configured to turn the submersible pump off when a fluid level of a reservoir within which the fluid mixing system is installed reaches a pre-determined low fluid set point.

16. The fluid mixing system of claim 1 wherein the upper portion further comprises a stability plate for stabilizing the submersible pump.

17. The fluid mixing system of claim 1 further comprising one or more of mounting clips and a brace configured for securing the fluid mixing system within a reservoir in which the fluid mixing system is installed.

18. The fluid mixing system of claim 5 further comprising one or more torque arrestors positioned within the base portion, wherein the one or more torque arrestor are positioned relative to the second pipe portion and/or the third pipe portion.

* * * * *